US005348285A

United States Patent [19]

Hüser

[11] Patent Number: 5,348,285

[45] Date of Patent: Sep. 20, 1994

[54] HOLD-DOWN DEVICE ON HANDLING MACHINES, IN PARTICULAR PUNCHING MACHINES, FOR THIN, FLAT OBJECTS IN PARTICULAR SHEETS OF PAPER

[75] Inventor: Peter Hüser, Ellerau, Fed. Rep. of Germany

[73] Assignee: Blohm & Voss AG, Hamburg, Fed. Rep. of Germany

[21] Appl. No.: 6,329

[22] Filed: Jan. 21, 1993

[30] Foreign Application Priority Data

Jan. 21, 1992 [DE] Fed. Rep. of Germany ..... 4201411

[51] Int. Cl.[5] ..... B65H 29/68; B65H 29/32

[52] U.S. Cl. ..... 271/183; 271/197; 271/203

[58] Field of Search ..... 271/183, 197X, 202, 203X

[56] References Cited

U.S. PATENT DOCUMENTS

| | | | |
|---|---|---|---|
| 1,156,903 | 10/1915 | Henderson | 271/183 |
| 2,474,997 | 7/1949 | Wormser | 271/183 |
| 2,969,980 | 1/1961 | Claybourn | 271/183 |
| 3,432,161 | 3/1969 | Dale et al. | 271/183 |
| 3,659,839 | 5/1972 | Baucke | 271/183 |
| 3,684,277 | 8/1972 | Buschmann | 271/197 X |
| 3,730,517 | 5/1973 | Norton | 271/183 |
| 3,843,116 | 10/1974 | Jiruse | 271/183 |
| 4,175,477 | 11/1979 | Inose et al. | 493/362 |
| 4,830,355 | 5/1989 | Jeschke | 271/183 |
| 4,903,560 | 2/1990 | Halff et al. | 83/277 |
| 5,133,542 | 7/1992 | von Kwiatkowski et al. | 271/183 |

FOREIGN PATENT DOCUMENTS

| | | |
|---|---|---|
| 0075685 | 8/1982 | European Pat. Off. . |
| 3903389 | 8/1990 | Fed. Rep. of Germany . |

*Primary Examiner*—Edward K. Look
*Assistant Examiner*—John Ryznic
*Attorney, Agent, or Firm*—Thomas N. Ljungman

[57] ABSTRACT

In handling machines, in particular punching machines, operating in discrete steps, for sheets of paper or similar objects, a warping, waving or wrinkling of the sheets occurs during the deceleration movements of the sheets ahead of the delivery station. These deformations are smoothed by the hold-down device according to the invention, which consists of a circulating perforated endless belt, to which an underpressure is applied from below. There is also synchronization between the feed movement of the sheets and the movement of the endless belt.

6 Claims, 6 Drawing Sheets

HOLD-DOWN DEVICE ON HANDLING MACHINES, IN PARTICULAR PUNCHING MACHINES, FOR THIN, FLAT OBJECTS IN PARTICULAR SHEETS OF PAPER

BACKGROUND OF THE INVENTION

1. Field of the Invention

This invention generally relates to a hold-down device on handling machines, in particular punching machines, for thin, flat objects, in particular sheets of paper. The handling machine includes several handling stations located at intervals in a series, through which the sheets can be fed in steps by means of an endless conveyor, in particular a feed or conveyor chain, by means of grippers. After an acceleration phase and a deceleration phase, the sheets remain in the respective handling station during a rest phase, whereby the sheets arrive at a delivery station after passing the final handling station.

2. Background Information

Generally, hold-down devices of the type described above are intended to prevent or eliminate, by smoothing, the warping, wrinkling, waving or folding of the sheets concerned. Such warping, wrinkling, waving and folding can tend to occur at high production speeds during the deceleration phase, in particular ahead of the delivery station, and can thus interfere with correct processing and even result in interruptions of operation. To accomplish smoothing, the following arrangements have been used: brake brushes; smoothing blocks; or blowing air currents acting on the sheet from above. Of course, each of the arrangements just listed may produce the desired smoothing effect, but, particularly when sheets of sensitive or delicate material are used, those arrangements tend to have the disadvantage that damage can be caused to the upper side of the sheet, or that the sheet can tear on account of the relatively large friction forces between the underside of the sheet and the sheet feed surface.

In the general field of handling machines for flat objects, in particular sheets of paper, German Laid Open Patent Appln. No. 39 03 389, or European Patent Appln. No. 0 075 685, disclose the use of endless belts provided with air passages, or openings. As disclosed in those patent applications, the upper strand of such a belt forms the support for the sheets, and the underside of the belt is guided over a suction box equipped with suction openings. These devices are used for the transport of the sheets by a system operating without conveyor chains, feed chains, or similar devices, but not for the smoothing of the sheets during deceleration in systems equipped with conveyor chains. Accordingly, essentially no synchronization is provided.

OBJECTS OF THE INVENTION

The objects of the invention, therefore, are: to eliminate the disadvantages just mentioned and, accordingly, create a hold-down device in which brake means acting on the upper side of the sheet, and relative movements between the sheet and its support, are essentially eliminated; to avoid any damage to the sheet on the upper side and the underside; and, at the same time, to achieve an effective smoothing action, or even improve the smoothing action.

SUMMARY OF THE INVENTION

The above and other objects are achieved in that, seen in the direction of the paper feed, shortly upstream of the delivery station, there is preferably at least one driven endless belt with air passage openings, the upper strand of which belt preferably forms the support for the sheets in this area. The upper strand of the endless belt is preferably guided over a suction box which is also preferably provided with air passage openings. An underpressure is preferably maintained in the suction box. The drive means of the endless belt are preferably configured so that the endless belt is substantially synchronized with the above-mentioned phases of the conveyor, but delayed by a small amount in relation to the latter. The term "underpressure", as used herein, generally refers to the application of a negative pressure, such as a suction. Terms which may be used as alternatives to the term "underpressure" are: "vacuum", "pressure below atmospheric", "negative or reduced pressure", and "partial vacuum".

According to the invention, the endless belt, which is equipped with openings for the passage of air, and on which an underpressure is exerted from below by means of the suction box, not only has a smoothing action as the feed surface moves along with the sheet, but also has a smoothing action exerted on the surface from underneath, whereby the movement of the sheet and the movement of the endless belt are preferably synchronized at all times.

A conceivable deviation of the synchronization is in the sense of a slight delay or deceleration, as long as the increase in the smoothing tension thereby achieved is significantly less than the tear strength of the sheet.

Additional advantageous embodiments of the present invention are disclosed hereinbelow. For example, in accordance with the present invention, a type of drive for the endless belt is provided which not only guarantees reliable synchronization between the drive of the entire system and the drive of the endless belt, if such synchronization is desirable, but also easily makes possible a slight delay or deceleration of the movement of the endless belt by means of a simple change of the transmission. In a particularly favorable manner, according to one embodiment of the present invention, even relatively large distances between the drives can be easily bridged.

An advantageous result achieved by the present invention is a savings of the energy required to generate the underpressure, because, according to one aspect of the present invention, the suction openings for the phases of movement in which no underpressure is desired are closed by the non-permeable area of the endless belt.

Another variant of the present invention makes it possible to reduce the surface area, while retaining the same overall width of the endless belt which, in particular with large sheets, has an advantageous effect on the expenditure for materials and drive energy.

In summary, one aspect of the invention resides broadly in sheet punching apparatus for punching a series of sheets and subsequently delivering the punched sheets, said apparatus comprising: means for punching the sheets; means for stacking the punched sheets; means for conveying the punched sheets from said punching means to said stacking means; means for holding the sheets down prior to the sheets being stacked; said holding means being disposed between said punching means and said stacking means with respect to a direction of travel of said conveying means; said holding means comprising: means for receiving the sheets, said receiving means being separate from said conveying means, for supporting the sheets prior to being stacked; suction means for holding the sheets on said receiving means; means for driving said receiving means; means for driving said conveying means; and means for coordinating driven movement of said receiving means and said conveying means.

Another aspect of the invention resides broadly in that, in a sheet punching apparatus, the sheet punching apparatus being for punching a series of sheets and subsequently delivering the punched sheets, the sheet punching apparatus comprising: means for punching the sheets, means for stacking the punched sheets, means for conveying the punched sheets from the punching means to the stacking means; means for driving the conveying means; means for holding the sheets down prior to the sheets being stacked, the holding means for being disposed between the punching means and the stacking means with respect to a direction of travel of the conveying means, said holding means comprises: means for receiving the sheets, said receiving means being separate from the conveying means, for supporting the sheets prior to being stacked; suction means for holding the sheets on said receiving means; means for driving said receiving means; and means for coordinating driven movement of said receiving means and the conveying means.

Yet another aspect of the invention resides broadly in a method of holding down sheets in a sheet punching apparatus, the sheet punching apparatus being for punching a series of sheet and subsequently delivering the punched sheets; the method comprising the steps of: providing means for punching the sheets; providing means for stacking the punched sheets; providing means for conveying the punched sheets from the punching means to the stacking means; providing means for holding the sheets down prior to the sheets being stacked; providing, for the holding means: means for receiving the sheets, the receiving means separate from the conveying means, for supporting the sheets prior to being stacked; and suction means for holding the sheets on the receiving means; providing means for driving the receiving means; providing means for driving the conveying means; providing means for coordinating the movement of the receiving means and the conveying means; disposing the holding means between the punching means and the stacking means; punching the sheets by means of the punching means; stacking the punched sheets by means of the stacking means; conveying the punched sheets, by means of the conveying means, from the punching means to the stacking means; prior to the step of stacking the punched sheets, holding the sheets down by means of the holding means; said step of holding the sheets down comprising the steps of: receiving the sheets on the receiving means; supporting the sheets by means of the receiving means; holding the sheets on the receiving means by means of the suction means; driving the receiving means; driving the conveying means; and coordinating the driven movement of the receiving means and the conveying means.

BRIEF DESCRIPTION OF THE DRAWING

The accompanying drawings illustrate embodiments of the present invention, wherein.

DESCRIPTION OF THE PREFERRED EMBODIMENTS

In all the figures, identical components are identified by the same reference numbers.

Figure 1:
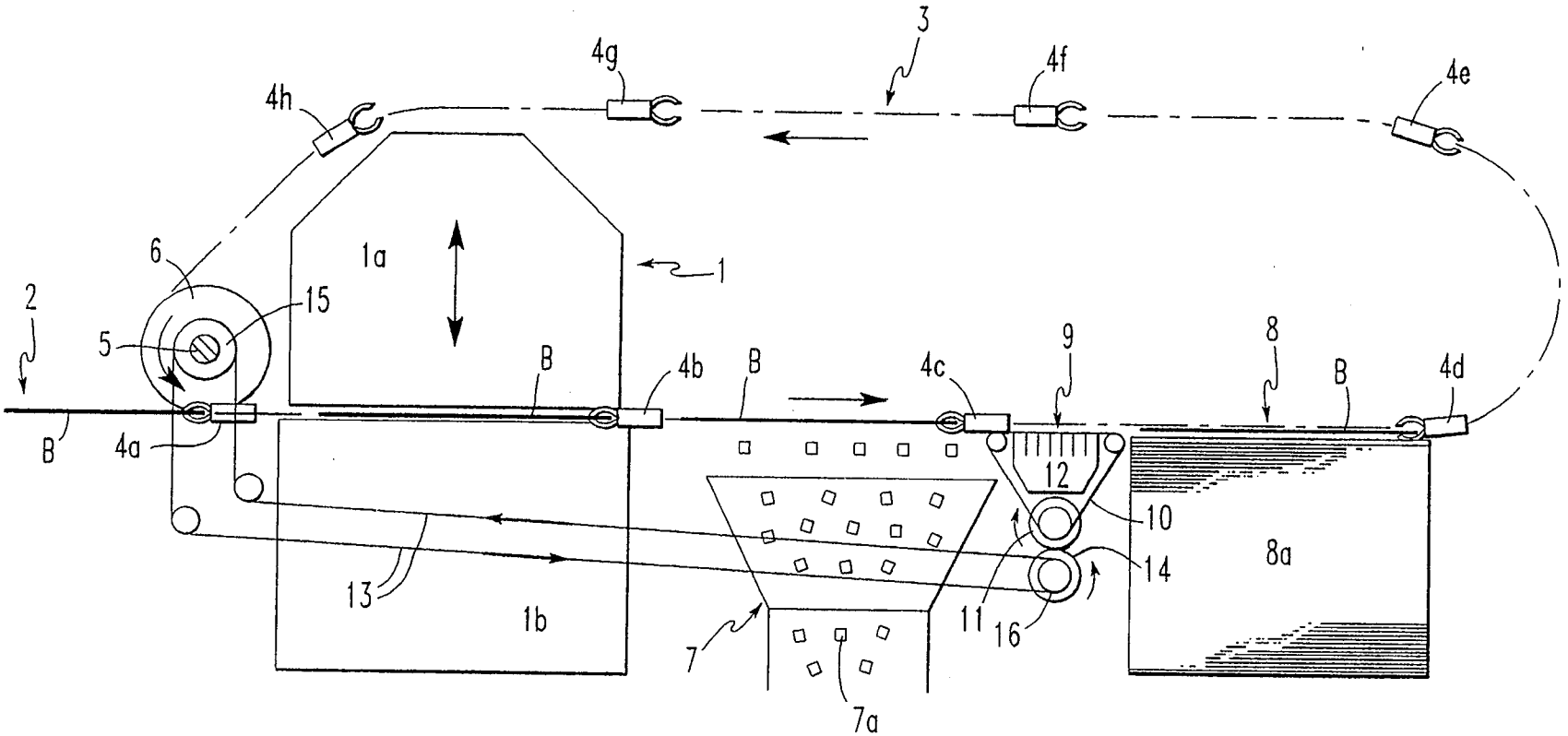
FIG. 1 shows an overall view of a handling machine, with a hold-down device and other auxiliary devices.

In FIG. 1, reference numeral 1 designates a punching station with a top table 1*a* which can be raised and lowered, and a stationary bottom table 1*b*.

Preferably, there is a circulating endless conveyor chain 3, which is equipped with gripper carriages 4*a* to 4*h* to hold sheets of paper B, and which is preferably guided by means of sprocket wheels. Out of the sprocket wheels just mentioned, only the drive sprocket wheel 6 is shown. Preferably, drive sprocket wheel 6 is upstream of the punching station 1 and is mounted on a chain drive shaft 5. Preferably, upstream of the punching station there is also a sheet feeder 2, while downstream of the punching station there is a clearing or breakout station 7 to remove the material 7*a* punched out from sheets B, and a delivery station 8 with a stack 8*a* for the sheets delivered from the punching station 1. It will be appreciated that the terms "upstream" and "downstream", as employed herein refer, respectively, to the direction opposite that in which sheets B are transported and to the direction in which sheets B are transported.

Thus, a handling machine employing the present invention may essentially include a sheet feeder 2, a punching station 1, a clearing station 7 and a delivery station 8. Preferably, a circulating endless conveyor chain 3 is provided which carries grippers 4*a*, 4*b*, 4*c*, 4*d*, 4*e*, and 4*f*, each of which grippers are preferably positioned along the length of chain 3. The chain 3 and grippers 4*a*–4*f* are preferably configured such that, in turn, one of the grippers 4*a*–4*f* will grasp a sheet B at the sheet feeder 2 and carry the sheet B as follows: to punching station 1; thence to clearing station 7, and, further downstream, to delivery station 8.

The punching action of punching station 1 is preferably provided by a vertical movement of top table 1*a* towards and away from stationary bottom table 1*b*. Of course, it is possible to employ other types of punching arrangements within the scope of the present invention.

Preferably, clearing or breakout station 7 is preferably arranged such that, as a sheet B is transported downstream from punching station 1, the punched-out material 7*a* will essentially be removed away from sheet B at breakout station 7, preferably by way of a falling action. Of course, it is possible, within the scope of the present invention, to utilize other appropriate means for removing punched-out material 7*a* from a sheet B.

Figure 2:
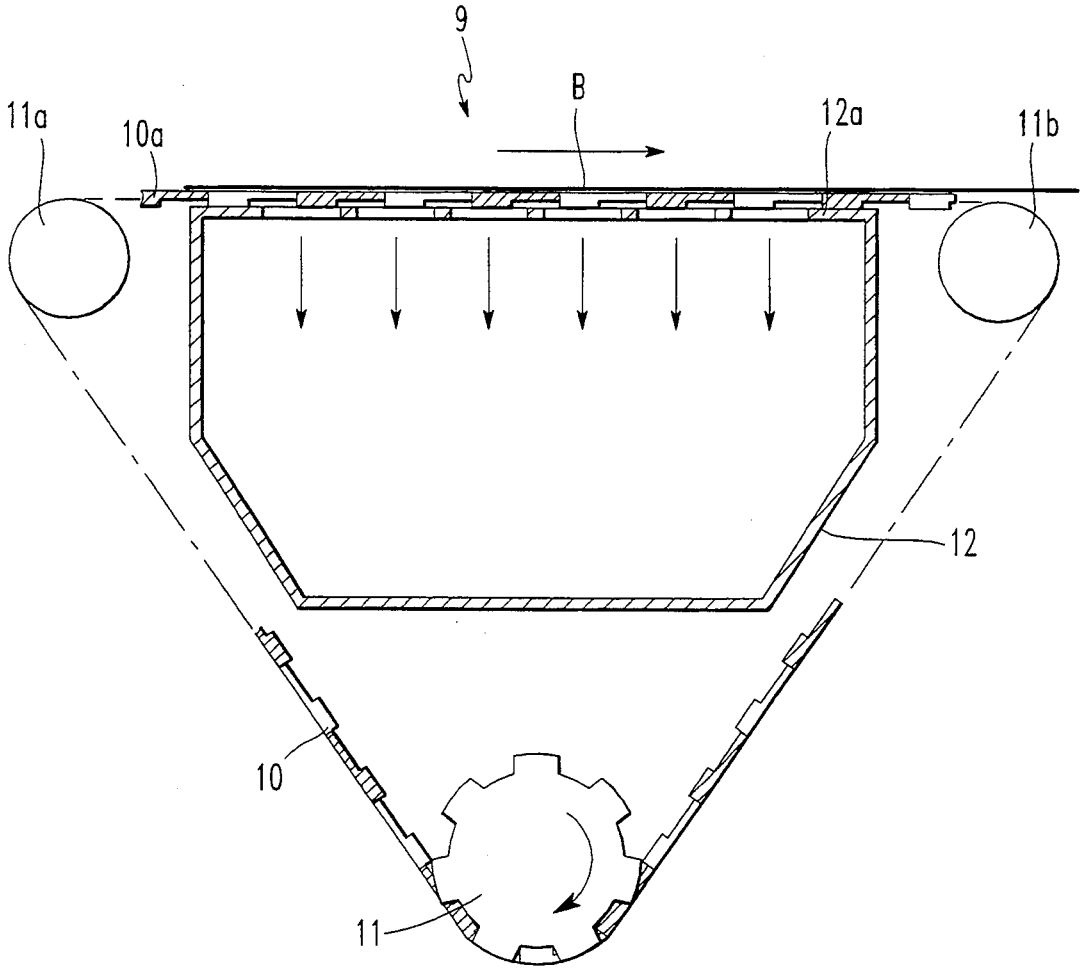
FIG. 2 is a detailed illustration of a hold-down device according to the invention.

Preferably, between the clearing station 7 and the delivery station 8, there is the hold-down device 9 according to the invention. This hold-down device 9 is shown in particular in FIG. 2. The hold-down device 9 preferably includes a circulating endless belt 10, which is preferably designed as a toothed belt. Belt 10 is preferably driven by a pinion gear 11 engaged with the teeth of belt 10.

An upper strand 10*a* of the endless belt 10, defined as that section of belt 10 between guide rollers 11*a*, 11*b*, runs parallel to the direction of movement of the sheet B, and loops over the top wall 12*a* of a suction box 12. An underpressure is preferably maintained in suction box 12.

Both the top wall 12*a* of the suction box 12 and the endless belt 10 preferably have air passages or openings, which transmit the underpressure to the sheet B lying on the upper strand 10*a* of the endless belt 10 to prevent the sheet B from lifting up from the upper strand 10*a*, or from forming waves or wrinkles on the sheet B.

Thus, in accordance with the present invention, hold-down device 9 is preferably provided downstream of breakout station 7 and upstream of delivery station 8. As shown more clearly in FIG. 2, hold-down station 9 preferably includes a circulating endless belt 10, which belt 10 is preferably carried by pinion gear 11 and guide rollers 11*a* and 11*b*. Guide rollers 11*a* and 11*b* are preferably disposed in the vicinity of chain 3 such that, when belt 10 is carried between guide rollers 11*a* and 11*b*, belt 10 will be essentially parallel with chain 3. As mentioned above, that portion of belt 10 being parallel with chain 3 is designated herein as upper strand 10*a*.

Belt 10 is preferably toothed internally and is preferably configured to engage with teeth of pinion gear 11. Pinion gear 11, as shown, is preferably disposed well below guide rollers 11*a* and 11*b*.

As shown, suction box 12 is preferably disposed immediately beneath upper strand 10*a* of belt 10 and preferably applies an underpressure, or downward suction, on a sheet B as the sheet B is carried therepast.

Figure 2A:
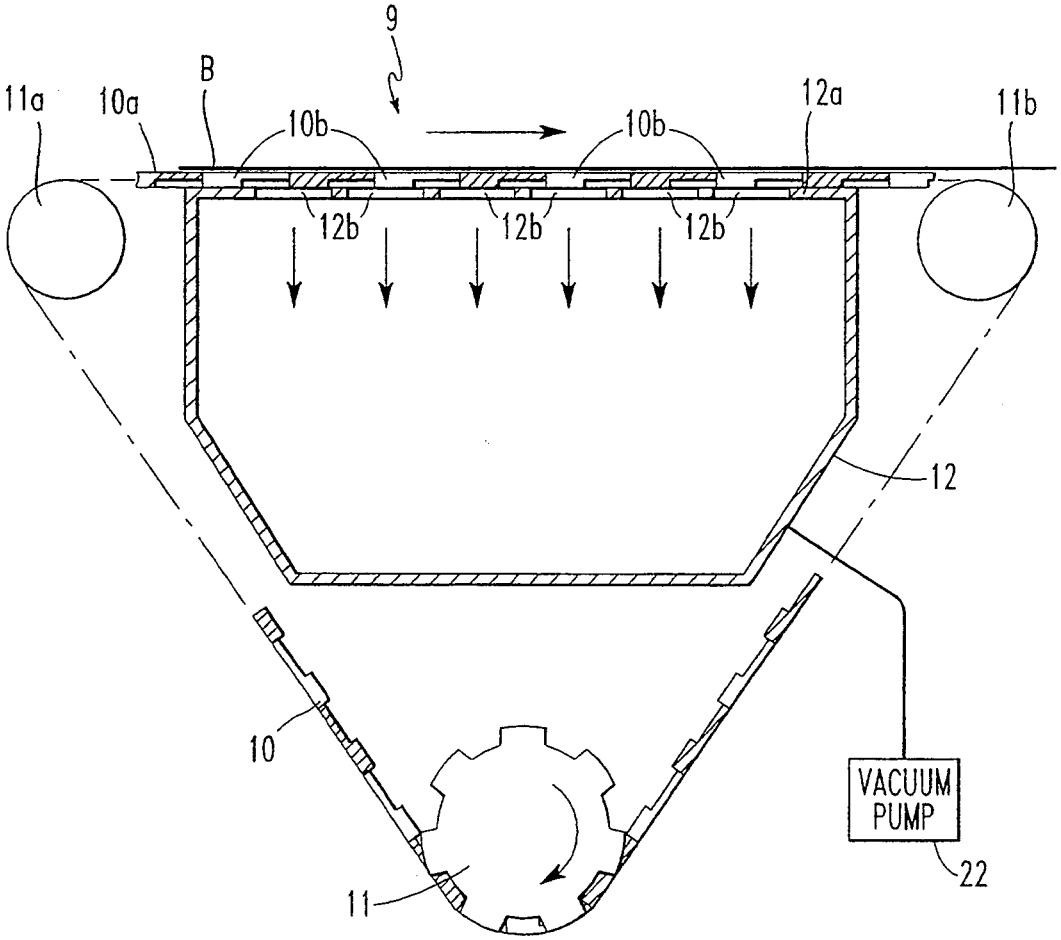
FIG. 2*a* is substantially the same view as FIG. 2, but additionally shows the vacuum pump mentioned above.

As is more particularly illustrated in FIG. 2*a*, top wall 12*a* of suction box 12 is preferably provided with openings 12*b* through which the suction force may be applied onto a sheet B. Additionally, belt 10 itself is preferably provided with openings 10*b* through which the suction force may also be applied onto a sheet B. The suction force may preferably be provided by a vacuum pump 22. Thus, essentially, as a sheet B passes over suction box 12, the suction force provided by suction box 12 is preferably transmitted, through openings 12*b* of upper wall 12*a* of box 12 and openings 10*b* of belt 10, onto sheet B. Preferably, openings 10*b* and 12*b* are configured such that, as sheet B passes over box 12, sheet B is prevented from lifting off of the upper strand 10*a* and from becoming waved or wrinkled.

To avoid a linear displacement of the sheet B and the upper strand 10*a* of belt 10 in relation to one another, the movement of the endless belt 10 is preferably synchronized with that of the drive chain 3, i.e. the three phases of movement of the drive chain 3, namely, the acceleration phase, the deceleration phase and the rest phase, are preferably transmitted in a non-slip manner to the endless belt 10.

As shown in FIG. 1, the synchronization is preferably accomplished by means of a toothed or synchronous belt drive 13 and a gear 14, possibly a rack gear or a rack-and-pinion gear, to reverse the direction of rotation, and corresponding to the toothed pinions 15, 16 engaged with the toothed belt 13.

Figure 1A:
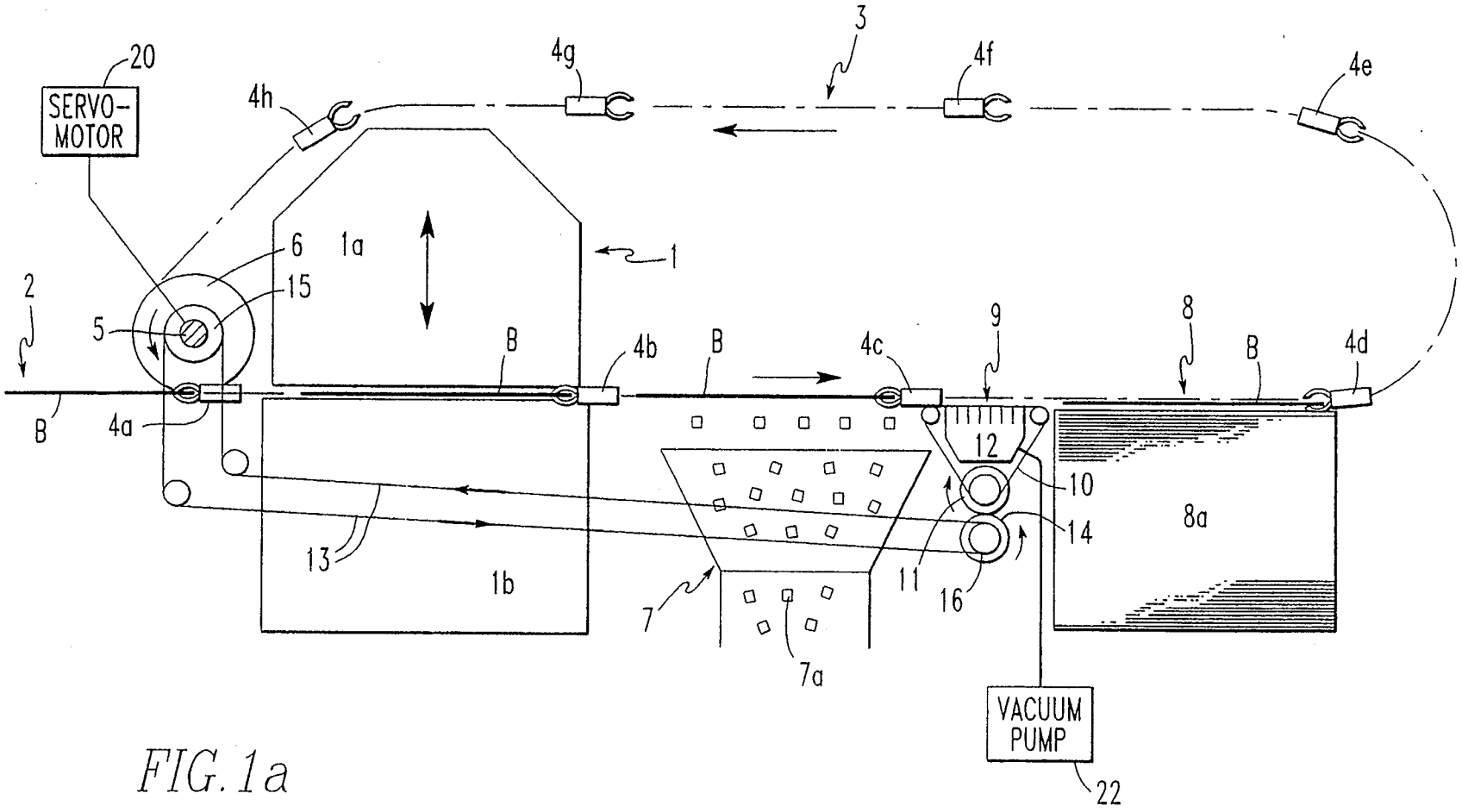
FIG. 1*a* is substantially the same view as FIG. 1, but additionally shows a motor and a vacuum pump.

FIG. 1*a* more particularly illustrates synchronized driving system according to one embodiment of the present invention. As illustrated therein, drive sprocket wheel 6 is preferably driven by a motor 20. Toothed belt 13 preferably extends from toothed pinion 15 to toothed pinion 16. Toothed pinion 15 is preferably coaxially disposed with respect to drive sprocket wheel 6, and configured to rotate therewith, and toothed pinion 16 is preferably mounted on gear 14, which in turn is preferably drivingly engageable with gear 11.

Figure 1B:
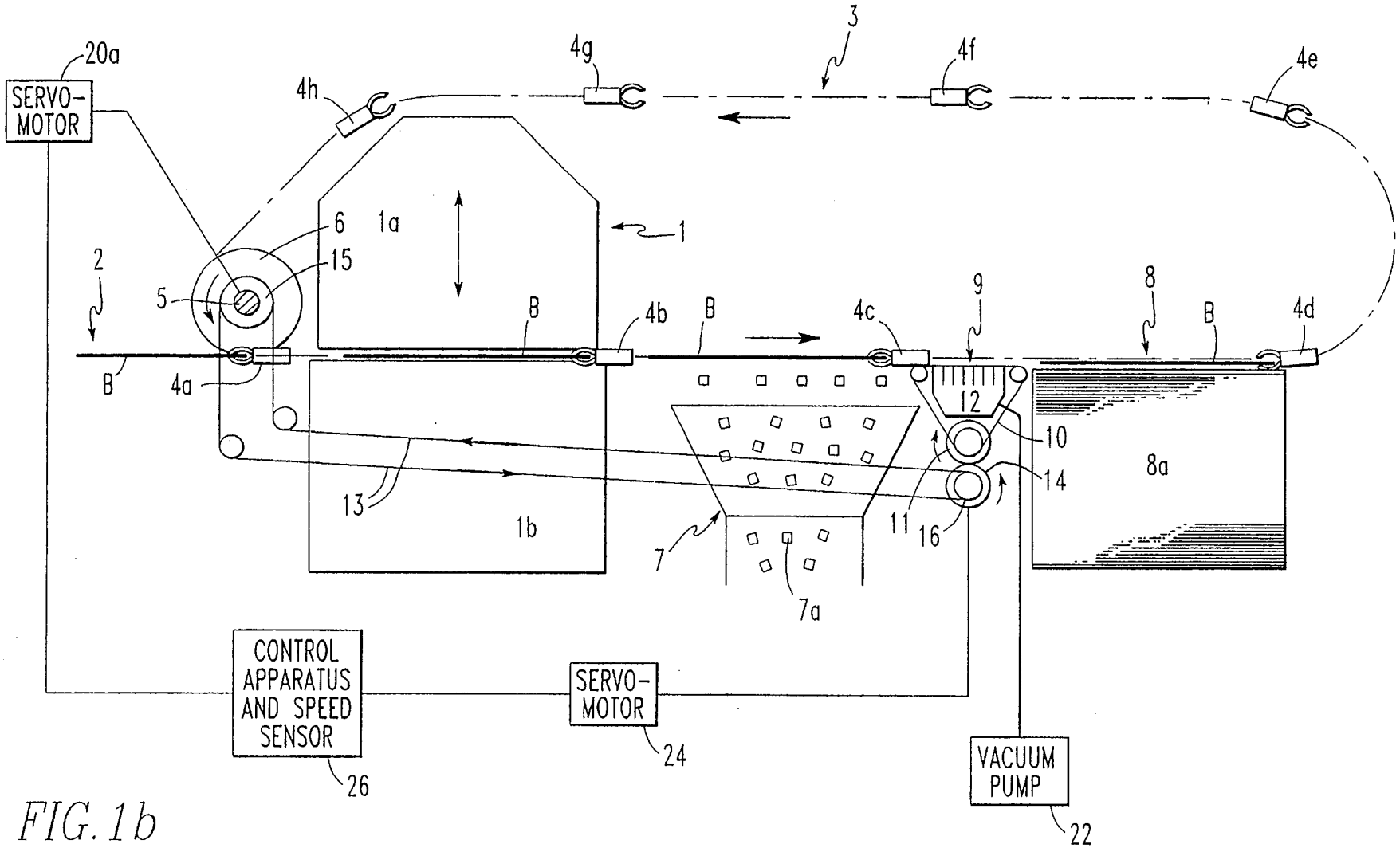
FIG. 1*b* is substantially the same view as FIG. 1, but additionally shows an alternative motor arrangement.

FIG. 1*b* shows an alternative embodiment in which, preferably, a first servomotor 20*a* is configured to drive sprocket wheel 6 and and a second servomotor, particularly a servomotor 24, is provided at gear 14. Accordingly, a control apparatus 26 may be provided between first servomotor 20*a* and second servomotor 24 for the purpose of controlling servomotors 20*a* and 24. Preferably, control apparatus 26 includes an appropriate speed sensor for sensing the speed of the conveyor chain 3 and/or endless belt 10. The function of servomotors is well-known and will not be discussed in further detail here.

It should be understood that, within the scope of the present invention, it is possible to utilize a servomotor arrangement such as that described immediately above, either with or without the concomitant use of belt 13. That is, among other things, it is possible to use solely a servomotor arrangement, with a first servomotor 20*a*, second servomotor 24, and control apparatus 26, or to use such a servomotor arrangement in conjunction with the belt arrangement described above, which belt arrangement includes belt 13, gear 14 and pinion 16. Of course, FIG. 1*b* illustrates the conjunctive use of a servomotor arrangement and a belt arrangement for the purpose of synchronization of chain 3 and belt 10.

It should also be understood that it is possible, within the scope of the present invention, to provide synchronized driving arrangements other than those discussed immediately above.

Figure 3:
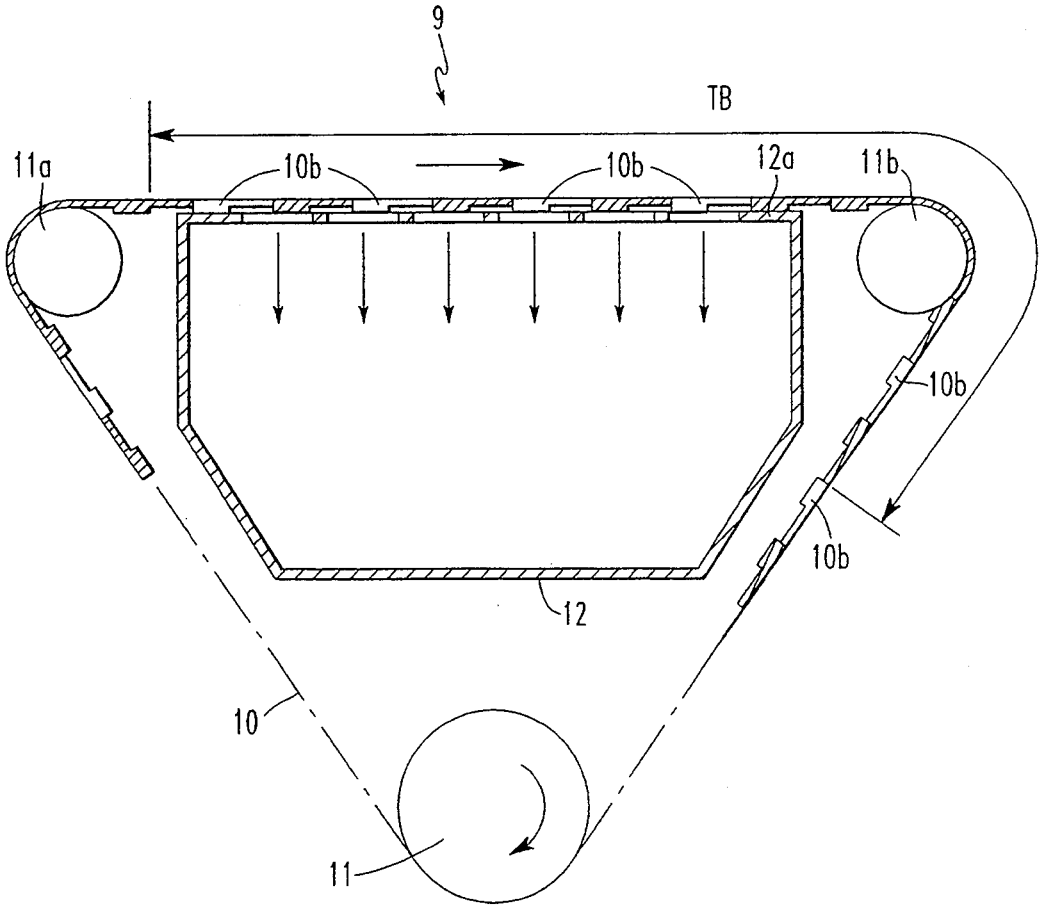
FIG. 3 shows the same hold-down device as in FIG. 2, but in this configuration, the endless belt is permeable to air only in certain areas.

FIG. 3 shows a variant of the hold-down device according to the present invention, in which the air passage openings do not extend over the entire length of the endless belt 10, but only over a portion TB of the belt. This portion TB is preferably sized and positioned so that during the corresponding deceleration phase of the sheet feed, portion TB is located over the air passage openings of the suction box 12, and thus only releases the suction effect in this phase, but interrupts the suction effect in the other phases of movement. A portion of the energy necessary for the generation and maintenance of the underpressure in the suction box 12 is thereby saved.

Therefore, in accordance with a preferred embodiment of the present invention, as particularly shown in FIG. 3, openings 10*b* in belt 10 are preferably provided along only a portion TB of the length of belt 10, rather than along the entire length of belt 10. The length of portion TB is preferably chosen such that suction will be provided through belt 10 essentially only during the deceleration phase of sheet handling. Also, the positioning of the openings 10*b* is chosen similarly. For example, it is conceivable, among other things, to position the openings 10*b* at substantially equal intervals with respect to one another, or to provide two or more sets of openings 10*b* wherein, within each set, the openings 10*b* are positioned at substantially equal intervals. In the latter case, it is conceivable that, between sets of openings 10*b*, there is an interval greater than the interval at which the openings 10*b* are spaced from one another within the sets.

The present invention also provides for a method of holding down sheets in a sheet punching apparatus.

According to the present invention, such a method may preferably include the steps of: punching sheets at the punching station 1; stacking the punched sheets at the delivery station 8; conveying the punched sheets, by means of the chain 3, from the punching station 1 to the delivery station 8; and, prior to the step of stacking the punched sheets, holding the sheets down by means of the hold-down device 9. The step of holding the sheets down includes the steps of: receiving the sheets on the upper strand 10*a* of belt 10; supporting the sheets by means of the upper strand 10*a* of belt 10; holding the sheets on the upper strand 10*a* of belt 10 by means of suction provided by the suction box 12; driving the belt 10; driving the chain 3; and coordinating the driven movement of the upper strand 10*a* of belt 10 and the chain 3. Other possible steps are discernible from the description of the preferred embodiments set forth heretofore.

One feature of the invention resides broadly in the hold-down device in handling machines, in particular punching machines, for thin, flat objects, in particular sheets of paper, consisting of several handling stations located at intervals in a series, through which the sheets can be fed in steps by means of an endless conveyor, in particular a feed or conveyor chain, by means of grippers, so that after an acceleration phase and a deceleration phase they remain in the respective handling station during a rest phase, whereby the sheets arrive at a delivery station after passing the final handling station, characterized by the fact that, seen in the direction of the paper feed, shortly upstream of the delivery station 8 there is at least one driven endless belt 10 with air passage openings, the upper strand 10*a* of which forms the support for the sheets B in this area, and is guided over a suction box 12 which is also provided with air passage openings, and in which an underpressure is maintained, and whose drive means 15, 13, 16, 14, 11 are configured so that it is synchronized with the above-mentioned phases of the conveyor 3, but delayed by a small amount in relation to the latter.

Another feature of the invention resides broadly in the hold-down device, characterized by the fact that when the conveyor 3 is designed as a feed or conveyor chain, the drive means for the endless belt 10 consist of a transmission located between the drive chain wheel or sprocket 6 of the conveyor 3 and the drive wheel 11 of the endless belt 10, where the transmission is designed as a transmission/toothed gearing 13/14.

Yet another feature of the invention resides broadly in the hold-down device, characterized by the fact that when the conveyor 3 is designed as a feed or conveyor chain, the drive means for the endless belt 10 consist of a speed sensor connected to the drive chain wheel or sprocket 6 of the conveyor 3, and an electric motor which drives the endless belt 10, whereby an electrical transmission is connected between the speed sensor and the electric motor.

Still another feature of the invention resides broadly in the hold-down device, characterized by the fact that the air passage openings of the endless belt 10 extend over only a portion of its total length, and that this portion is sized and positioned so that only during the deceleration phase can the underpressure act on the sheet, whereby the endless belt 10 is designed as a toothed belt and the drive wheel 11 as a drive pinion.

Still yet another feature of the invention resides broadly in the hold-down device, characterized by the fact that the endless belt 10 consists of two or more partial endless belts guided parallel at some distance from and next to one another, whereby the suction openings in the top wall of the suction box are restricted to the zone over which the partial endless belts pass.

Examples of sheet feeding arrangments, which may be utilized in accordance with the embodiments of the present invention, may be found in the following U.S. Pat. No. 5,102,117, which issued to Henn et al. on Apr. 7, 1992; and No. 5,096,179, which issued to Schmitt on Mar. 17, 1992.

Examples of gripping and conveying systems, which may be utilized in accordance with the embodiments of the present invention, may be found in the following U.S. Pat. No. 4,479,645, which issued to Pollich on Oct. 30, 1984; and No. 4,083,556, which issued to Schilling et al. on Apr. 11, 1978.

Examples of sheet delivery arrangements, which may be utilized in accordance with the embodiments of the present invention, may be found in the U.S. Patents listed above and additionally in the following U.S. Pat. No. 4,243,166, which issued to Vossen and Vossen on Jan. 6, 1981.

Examples of sheet punching arrangements, which may be utilized in accordance with the embodiments of the present invention, may be found in the following U.S. Pat. No. 4,903,560, which issued to Halff et al. on Feb. 27, 1990; No. 4,243,166, which issued to Vossen and Vossen on Jan. 6, 1981; and No. 4,175,477, which issued to Inose et al. on Nov. 27, 1979.

Examples of suction arrangements, which may be utilized in accordance with the embodiments of the present invention, may be found in the following U.S. Pat. No. 4,830,355, which issued to Jeschke on May 16, 1989; and No. 4,083,556, which issued to Schilling et al. on Apr. 11, 1978.

Examples of servomotor mechanisms, which may be utilized in accordance with the embodiments of the present invention, may be found in the following U.S. Pat. No. 4,935,683, which issued to Kobler et al. on Jun. 19, 1990; and No. 4,449,866, which issued to Lohneis, et al. on May 22, 1984.

All, or substantially all, of the components and methods of the various embodiments may be used in any combination with at least one embodiment or all of the embodiments, if any, described herein.

All of the patents, patent applications and publications recited herein and in the attached declaration, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Sheet punching apparatus for punching a series of sheets and subsequently delivering the punched sheets, said apparatus comprising:

means for punching the sheets;
means for stacking the punched sheets;
means for conveying the punched sheets from said punching means to said stacking means;
means for holding the sheets down prior to the sheets being stacked;
said holding means being disposed between said punching means and said stacking means with respect to a direction of travel of said conveying means;
said hold means comprising:
means for receiving the sheets, said receiving means being separate from said conveying means, for supporting the sheets prior to being stacked;
suction means for holding the sheets on said receiving means;
means for driving said receiving means;
means for driving said conveying means;
means for coordinating driven movement of said receiving means and said conveying means;
said coordinating means comprising means for synchronizing the driven movement of said receiving means and said conveying means;
said means for driving said conveying means being configured for driving said conveying means to convey the sheets through at least an acceleration phase and a deceleration phase;
said synchronizing means comprising means for synchronizing the driven movement of said receiving means with the acceleration and deceleration phases of said conveying means and decreasing the speed of said receiving means by a small amount with respect to that of said conveying means;
said synchronizing means being configured for providing a tension on each of the sheets as a result of the delay of the driven movement of said receiving means with respect to the acceleration and deceleration phases of said conveying means, the provided tension for being significantly less than a tear strength of each of the sheets;
said receiving means comprising at least one driven endless belt;
said at least one driven endless belt having an upper run, said upper run of said at least one driven endless belt for receiving the sheets thereupon and supporting the sheets;
said suction means being disposed below said upper run of said at least one driven endless belt;
said at least one driven endless belt comprising at least one opening for permitting the application of a suction force from said suction means onto an underside of the sheets to hold the sheets on said at least one driven endless belt;
said suction means comprising a suction box, said suction box being disposed below said upper run of said at least one driven endless belt;
said suction box comprising an upper portion disposed parallel to said upper run of said at least one driven endless belt;
said suction box being configured to provide the suction force through the at least one opening of said at least one driven endless belt to hold the sheets on said at least one driven endless belt;
said suction box comprising at least one opening, said at least one opening of said suction box being configured for being aligned with said at least one opening of said at least one driven endless belt to provide the suction force through said at least one opening of said at least one driven endless belt;
said at least one opening of said at least one driven endless belt comprising a plurality of openings;
said at least one opening of said suction box comprising a plurality of openings;
said plurality of openings of said suction box being configured for being aligned with said plurality of openings of said at least one driven endless belt;
a delivery station, said delivery station for being positioned adjacent said receiving means and being configured for receiving sheets from said receiving means;
said conveying mans comprises an endless feed chain, said feed chain comprising a plurality of grippers for successively gripping the sheets and releasing the sheets at said receiving means;
said feed chain having an upper run and a lower run, said lower run running in a direction parallel to said upper run of said at least one driven endless belt in the vicinity of said upper run of said at least one driven endless belt;
said means for driving said conveying means comprising first drive wheel means and a drive motor for driving said first drive wheel means;
said first drive wheel means being configured for transferring a driving force from said drive motor to said feed chain;
said means for driving said receiving means comprising:
second drive wheel means;
drive belt means extending from said first drive wheel means to said second drive wheel means, said drive belt means being configured for transferring a driving force from said first drive wheel means to said second drive wheel means;
said second drive wheel means being configured for transferring the driving force from said drive belt means to said at least one driven endless belt;
said synchronizing means comprising said drive belt means, said drive belt means being configured for decreasing the speed of said receiving means by a small amount with respect to that of said conveying means;
said first drive wheel means comprising a first drive wheel;
said second drive wheel means comprising a second drive wheel;
each of said first drive wheel and said second drive wheel being toothed;
said drive belt means comprising a toothed belt for being engaged with the teeth of said first drive wheel and the teeth of said second drive wheel;
said at least one driven endless belt having a total length defined along the travel of said at least one driven endless belt;
said plurality of openings of said at least one driven endless belt being disposed over a minor portion of the total length of said at least one driven endless belt;
said plurality of openings of said suction box for being aligned with said plurality of openings of said at least one driven endless belt such that a suction force is provided on each sheet only during a deceleration phase;
said second drive wheel being a drive pinion;
said second drive wheel means further comprising a pinion gear;

said drive pinion being engaged with said pinion gear to drive said pinion gear;

said at least one driven endless belt being at least one toothed belt;

said pinion gear being engaged with the teeth of said at least one driven endless belt to drive said at least one driven endless belt;

said at least one driven endless belt comprising at least two driven endless belts;

said at least two driven endless belts being disposed parallel to one another;

each of said at least two driven endless belts being configured to pass over a corresponding zone of said suction box;

said plurality of openings of said suction box being disposed solely in said zones over which said at least two driven endless belts pass;

each of said at least two driven endless belts being mounted on a generally triangular loop;

said second drive wheel constituting an apex of said generally triangular loop;

a pair of guide rollers, each of said pair of guide rollers being disposed in the vicinity of said feed chain;

said pair of guide rollers being disposed to carry said upper strand of said at least one driven endless belt therebetween; and each of said pair of guide rollers constituting another corresponding apex of said generally triangular loop.

2. Sheet punching apparatus for punching a series of sheets and subsequently delivering the punched sheets, said apparatus comprising:

means for punching the sheets;

means for stacking the punched sheets;

means for conveying the punched sheets from said punching means to said stacking means;

means for holding the sheets down prior to the sheets being stacked;

said holding means being disposed between said punching means and said stacking means with respect to a direction of travel of said conveying means;

said holding means comprising:

means for receiving the sheets, said receiving means being separate from said conveying means, for supporting the sheets prior to being stacked;

suction means for holding the sheets on said receiving means;

means for driving said receiving means;

means for driving said conveying means;

means for coordinating driven movement of said receiving means and said conveying means;

said coordinating means comprising means for synchronizing the driven movement of said receiving means and said conveying means;

said means for driving said conveying means being configured for driving said conveying means to convey the sheets through at least an acceleration phase and a deceleration phase;

said synchronizing means comprising means for synchronizing the driven movement of said receiving means with the acceleration and deceleration phases of said conveying means and decreasing the speed of said receiving means by a small amount with respect to that of said conveying means;

said synchronizing means being configured for providing a tension on each of the sheets as a result of the delay of the driven movement of said receiving means with respect to the acceleration and deceleration phases of said conveying means, the provided tension for being significantly less than a tear strength of each of the sheets;

said receiving means comprising at least one driven endless belt;

said at least one driven endless belt having an upper run, said upper run of said at least one driven endless belt for receiving the sheets thereupon and supporting the sheets;

said suction means being disposed below said upper run of said at least one driven endless belt;

said at least one driven endless belt comprising at least one opening for permitting the application of a suction force from said suction means onto an underside of the sheets to hold the sheets on said at least one driven endless belt;

said suction means comprising a suction box, said suction box being disposed below said upper run of said at least one driven endless belt;

said suction box comprising an upper portion disposed parallel to said upper run of said at least one driven endless belt;

said suction box being configured to provide the suction force through the at least one opening of said at lest one driven endless belt to hold the sheets on said at lest one driven endless belt;

said suction box comprising at lest one opening, said at least one opening of said suction box being configured for being aligned with said at least one opening of said at least one driven endless belt to provide the suction force through said at least one opening of said at least one driven endless belt;

said at least one opening of said at least one driven endless belt comprising a plurality of openings;

said at least one opening of said suction box comprising a plurality of openings;

said plurality of openings of said suction box being configured for being aligned with said plurality of openings of said at least one driven endless belt;

a delivery station, said delivery station for being positioned adjacent said receiving means and being configured for receiving sheets from said receiving means;

said conveying means comprises an endless feed chain, said feed chain comprising a plurality of grippers for successively gripping the sheets and releasing the sheets at said receiving means;

said feed chain having an upper run and a lower run, said lower run running in a direction parallel to said upper run of said at least one driven endless belt in the vicinity of said upper run of said at least one driven endless belt;

said means for driving said conveying means comprising first drive wheel means and a first drive motor for driving said first drive wheel means;

said first drive wheel means being configured for transferring a driving force from said first drive motor to said feed chain;

said means for driving said receiving means comprising second drive wheel means and a second drive motor for driving said second drive wheel means;

said second drive wheel means being configured for transferring a driving force from said second drive motor to said at least one driven endless belt;

said synchronizing means comprising:
speed sensor means for sensing a speed of said feed chain;
said speed sensor being connected with said first drive wheel means;
control means associated with said speed sensor means for controlling said second drive motor;
said control means being configured for controlling a speed of said second drive motor in relation to the sensed speed of said feed chain in order to synchronize the driven movement of said at least one driven endless belt with the acceleration and deceleration phases of said conveying means and decrease the speed of said at least one driven endless belt by a small amount with respect to that of said conveying means;
each of said first and second drive motors comprising a servomotor;
at least said second drive motor being an electric motor;
said at least one driven endless belt having a total length defined along the travel of said at least one driven endless belt;
said plurality of openings of said at least one driven endless belt being disposed over a minor portion of the total length of said at least one driven endless belt;
said plurality of openings of said suction box for being aligned with said plurality of openings of said at least one driven endless belt such that a suction force is provided on each sheet only during a deceleration phase;
said second drive wheel means comprising a drive pinion;
said second drive wheel means further comprising a pinion gear;
said drive pinion being engaged with said pinion gear to drive said pinion gear;
said at least one driven endless belt being at least one toothed belt;
said pinion gear being engaged with the teeth of said at least one driven endless belt to drive said at least one driven endless belt;
said at least one driven endless belt comprising at lest two driven endless belts;
said at least two driven endless belts being disposed parallel to one another;
each of said at least two driven endless belts being configured to pass over a corresponding zone of said suction box;
said plurality of openings of said suction box being disposed solely in said zones over which said at least two driven endless belts pass;
each of said at least two driven endless belts being mounted on a generally triangular loop;
said second drive wheel constituting an apex of said generally triangular loop;
a pair of guide rollers, each of said pair of guide rollers being disposed in the vicinity of said feed chain;
said pair of guide rollers being disposed to carry said upper strand of said at least one driven endless belt therebetween; and
each of said pair of guide rollers constituting another corresponding apex of said generally triangular loop.

3. In a sheet punching apparatus, the sheet punching apparatus being for punching a series of sheets and subsequently delivering the punched sheets, wherein:
the sheet punching apparatus comprises:
means for punching the sheets,
means for stacking the punched sheets,
means for conveying the punched sheets from the punching means to the stacking means;
means for driving the conveying means;
means for holding the sheets down prior to the sheets being stacked, the holding means for being disposed between the punching means and the stacking means with respect to a direction of travel of the conveying means, said holding means comprising;
means for receiving the sheets, said receiving means being separate from the conveying means, for supporting the sheets prior to being stacked;
suction means for holding the sheets on said receiving means;
means for driving said receiving means; and
means for coordinating driven movement of said receiving means and the conveying means;
said coordinating means comprises means for synchronizing the driven movement of said receiving mans and said conveying means;
the means for driving the conveying means is configured for driving the conveying means to convey the sheets through at least an acceleration phase and a deceleration phase;
said synchronizing means comprises means for synchronizing the driven movement of said receiving means with the acceleration and deceleration phases of the conveying means and decreasing the speed of said receiving means by a small amount with respect to that of the conveying means;
said synchronizing means is configured for providing a tension on each of the sheets as a result of the delay of the driven movement of said receiving means with respect to the acceleration and deceleration phases of the conveying means, the provided tension for being significantly less than a tear strength of each of the sheets;
said receiving means comprises at least one driven endless belt;
said at least one driven endless belt has an upper run, said upper run of said at least one driven endless belt for receiving the sheets thereupon and supporting the sheets;
said suction means is disposed below said upper run of said at least one driven endless belt;
said at least one driven endless belt comprises at least one opening for permitting the application of a suction force from said suction means onto an underside of the sheets to hold the sheets on said at least one driven endless belt;
said suction means comprising a suction box, said suction box being disposed below said upper run of said at least one driven endless belt;
said suction box comprising an upper portion disposed parallel to said upper run of said at least one driven endless belt;
said suction box being configured to provide the suction force through the at least one opening of said at least one driven endless belt to hold the sheets on said at least one driven endless belt;
said suction box comprising at least one opening, said at least one opening of said suction box being configured for being aligned with said at least one opening of said at least one driven endless belt to provide the suction force through said at least one opening of said at least one driven endless belt;

said at least one opening of said at least one driven endless belt comprising a plurality of openings;

said at least one opening of said suction box comprising a plurality of openings;

said plurality of openings of said suction box being configured for being aligned with said plurality of openings of said at lest one driven endless belt;

the conveying means comprises an endless feed chain, the feed chain comprising a plurality of grippers for successively gripping the sheets and releasing the sheets at said receiving means;

the feed chain having an upper run and a lower run, the lower run for running in a direction parallel to said upper run of said at least one driven endless belt in the vicinity of said upper run of said at least one driven endless belt;

the means for driving the conveying means comprising first drive wheel means and a drive motor for driving the first drive wheel means;

the first drive wheel means being configured for transferring a driving force from said drive motor to said fee chain;

said means for driving said receiving means comprising:

second drive wheel means;

drive belt means for extending from the first drive wheel means to said second drive wheel means, said drive belt means being configured for transferring a driving force from said first drive wheel means to said second drive wheel means;

said second drive wheel means being configured for transferring the driving force from said drive belt means to said at least one driven endless belt;

said synchronizing means comprising said drive belt means, said drive belt means being configured for decreasing the speed of said receiving means by a small amount with respect to that of the conveying means;

said second drive wheel means comprising a drive wheel;

said second drive wheel being toothed;

said drive belt means comprising a toothed belt for being engaged with the teeth of said second drive wheel;

said at least one driven endless belt having a total length defined along the travel of said at least one driven endless belt;

said plurality of openings of said at least one driven endless belt being disposed over a minor portion of the total length of said at least one driven endless belt;

said plurality of openings of said suction box for being aligned with said plurality of openings of said at least one driven endless belt such that a suction force is provided on each sheet only during a deceleration phase;

said drive wheel being a drive pinion;

said second drive wheel means further comprising a pinion gear;

said drive pinion being engaged with said pinion gear to drive said pinion gear;

said at least one driven endless belt being at least one toothed belt;

said pinion gear being engaged with the teeth of said at least one driven endless belt to drive said at least one driven endless belt;

said at least one driven endless belt comprising at least two driven endless belts;

said at least two driven endless belts being disposed parallel to one another;

each of said at least two driven endless belts being configured to pass over a corresponding zone of said suction box;

said plurality of openings of said suction box being disposed solely in said zones over which said at least two driven endless belts pass;

each of said at least two driven endless belts being mounted on a generally triangular loop;

said second drive wheel constituting an apex of said generally triangular loop;

a pair of guide rollers, each of said pair of guide rollers being disposed in the vicinity of said feed chain;

said pair of guide rollers being disposed to carry said upper strand and said at least one driven endless belt therebetween; and each of said pair of guide rollers constituting another corresponding apex of said generally triangular loop.

4. In a sheet punching apparatus, the sheet punching apparatus being for punching a series of sheets and subsequently delivering the punched sheets, wherein:

the sheet punching apparatus comprises:

means for punching the sheets, means for stacking the punched sheets, means for conveying the punched sheets from the punching means to the stacking means;

means for driving the conveying means;

means for holding the sheets down prior to the sheets being stacked, the holding means for being disposed between the punching means and the stacking means with respect to a direction of travel of the conveying means, said holding means comprising:

means for receiving the sheets, said receiving means being separate from the conveying means, for supporting the sheets prior to being stacked;

suction means for holding the sheets on said receiving means;

means for driving said receiving means; and means for coordinating driven movement of said receiving means and the conveying mans;

said coordinating means comprises means for synchronizing the driven movement of said receiving means and said conveying means;

the means for driving the conveying means is configured for driving the conveying means to convey the sheets through at least an acceleration phase and a deceleration phase;

said synchronizing means comprises means for synchronizing the driven movement of said receiving means with the acceleration and deceleration phases of the conveying means and decreasing the speed of said receiving means by a small amount with respect to that of the conveying means;

said synchronizing means is configured for providing a tension on each of the sheets as a result of the delay of the driven movement of said receiving means with respect to the acceleration and deceleration phases of the conveying means, the provided tension for being significantly less than a tear strength of each of the sheets;

said receiving means comprises at least one driven endless belt;

said at least one driven endless belt has an upper run, said upper run of said at least one driven endless belt for receiving the sheets thereupon and supporting the sheets;

said suction means is disposed below said upper run of said at least one driven endless belt;

said at least one driven endless belt comprises at least one opening for permitting the application of a suction force from said suction means onto an underside of the sheets to hold the sheets on said at least one driven endless belt;

said suction means comprising a suction box, said suction box being disposed below said upper run of said at least one driven endless belt;

said suction box comprising an upper portion disposed parallel to said upper run of said at least one driven endless belt;

said suction box being configured to provide the suction force through the at least one opening of said at least one driven endless belt to hold the sheets on said at least one driven endless belt;

said suction box comprising at least one opening, said at least one opening of said suction box being configured for being aligned with said at least one opening of said at least one driven endless belt to provide the suction force through said at least one opening of said at least one driven endless belt;

said at least one opening of said at least one driven endless belt comprising a plurality of openings;

said at least one opening of said suction box comprising a plurality of openings;

said plurality of openings of said suction box being configured for being aligned with said plurality of openings of said at least one driven endless belt;

the conveying means comprises an endless feed chain, the feed chain comprising a plurality of grippers for successively gripping the sheets and releasing the sheets at said receiving means;

the feed chain having an upper run and a lower run, said lower run for running in a direction parallel to said upper run of said at least one driven endless belt in the vicinity of said upper run of said at least one driven endless belt;

the means for driving the conveying means comprising first drive wheel means and a first drive motor for driving the first drive wheel means;

the first drive wheel means being configured for transferring a driving force from the first drive motor to the feed chain;

said means for driving said receiving means comprising second drive wheel means and a second drive motor for driving said second drive wheel means;

said second drive wheel means being configured for transferring a driving force from said second drive motor to said at least one driven endless belt;

said synchronizing means comprising:

speed sensor means for sensing a speed of the feed chain;

said speed sensor being connected with the first drive wheel means;

control means associated with said speed sensor means for controlling said second drive motor;

said control means being configured for controlling a speed of said second drive motor in relation to the sensed speed of the feed chain in order to synchronize the driven movement of said at least one driven endless belt with the acceleration and deceleration phases of the conveying means and decrease the speed of said at least one driven endless belt by a small amount with respect to that of the conveying means;

said second drive motor comprising a servomotor;

said second drive motor being an electric motor;

said at least one driven endless belt having a total length defined along the travel of said at least one driven endless belt;

said plurality of openings of said at least one driven endless belt being disposed over a minor portion of the total length of said at least one driven endless belt;

said plurality of openings of said suction box for being aligned with said plurality of openings of said at least one driven endless belt such that a suction force is provided on each sheet only during a deceleration phase;

said second drive wheel means comprising a drive pinion;

said second drive wheel means further comprising a pinion gear;

said drive pinion being engaged with said pinion gear to drive said pinion gear;

said at least one driven endless belt being at least one toothed belt;

said pinion gear being engaged with the teeth of said at least one driven endless belt to drive said at least one driven endless belt;

said at least one driven endless belt comprising at least two driven endless belts;

said at least two driven endless belts being disposed parallel to one another;

each of said at least two driven endless belts being configured to pass over a corresponding zone of said suction box;

said plurality of openings of said suction box being disposed solely in said zones over which said at least two driven endless belts pass;

each of said at least two driven endless belts being mounted on a generally triangular loop;

said second drive wheel constituting an apex of said generally triangular loop;

a pair of guide rollers, each of said pair of guide rollers being disposed in the vicinity of said feed chain;

said pair of guide rollers being disposed to carry said upper strand of said at least one driven endless belt therebetween; and each of said pair of guide rollers constituting another corresponding apex of said generally triangular loop.

5. Method of holding down sheet is a sheet punching apparatus, the sheet punching apparatus being for punching a series of sheets and subsequently delivering the punched sheets;

said method comprising the steps of:

providing means for punching the sheets;

providing means for stacking the punched sheets;

providing means for conveying the punched sheets from the punching means to the stacking means;

providing means for holding the sheets down prior to the sheets being stacked;

providing, for the holding means:

means for receiving the sheets, the receiving means separate from the conveying means, for supporting the sheets prior to being stacked; and suction means for holding the sheets on the receiving means;

providing means for driving the receiving means;

providing means for driving the conveying means;

providing means for coordinating the movement of the receiving means and the conveying means;

disposing the holding mans between the punching means and the stacking means;

punching the sheets by means of the punching means;

stacking the punched sheets by means of the stacking means;

conveying the punched sheets, by means of the conveying means, from the punching mans to the stacking means;

prior to the step of stacking the punched sheets, holding the sheets down by means of the holding means;

said step of holding the sheets down comprising the steps of:

receiving the sheets on the receiving means;

supporting the sheets by means of the receiving means;

holding the sheets on the receiving means by means of the suction means;

driving the receiving means;

driving the conveying means; and coordinating the driven movement of the receiving means and the conveying means;

said step of providing the coordinating means comprising the step of providing means for synchronizing the driven movement of the receiving mans and the conveying means;

said coordinating step comprising the step of synchronizing the driven movement of the receiving means and the conveying means;

said step of driving the conveying means comprising at least the steps of:

driving the conveying means to convey the sheets through an acceleration phase; and driving the conveying means to convey the sheets through a deceleration phase;

said step of providing the synchronizing means comprises the step of providing means for synchronizing the driven movement of the receiving means with the acceleration and deceleration phases of the conveying means and decreasing the speed of the receiving means by a small amount with respect to that of the conveying means;

said synchronizing step comprises the steps of synchronizing the driven movement of the receiving means with the acceleration and deceleration phases of the conveying mans and delaying the driven movement of the receiving means by a small amount with respect to the acceleration and deceleration phases of the conveying means;

configuring the synchronizing means for providing a tension on each of the sheets as a result of the delay of the driven movement of the receiving means with respect to the acceleration and deceleration phases of the conveying means, the provided tension for being significantly less than a tear strength of each of the sheets;

said synchronizing step comprising the step of providing a tension on each of the sheets as a result of the delay of the driven movement of the receiving means with respect to the acceleration and deceleration phases of the conveying means, the provided tension for being significantly less than the tear strength of each of the sheets;

said step of providing the receiving means comprising the step of providing at least one driven endless belt, the at least one driven endless belt has an upper run, the upper run of the at least one driven endless belt for receiving the sheets thereupon and supporting the sheets;

disposing the suction means below the upper run of the at least one driven endless belt;

configuring the at least one driven endless belt to comprise at least one opening for permitting the application of a suction force from the suction means onto an underside of the sheets to hold the sheets on the at least one driven endless belt;

said receiving step comprising the step of receiving the sheets upon the upper run of the at least one driven endless belt and supporting the sheets thereupon;

said holding step comprising the step of applying, via the at least one opening of the at least one driven endless belt, a suction force from the suction means onto an underside of the sheets;

configuring the apparatus such that the apparatus comprises:

the suction means comprising a suction box, the suction box being disposed below the upper run of the at least one driven endless belt;

the suction box comprising an upper portion disposed parallel to the upper run of the at last one driven endless belt;

the suction box being configured to provide the suction force through the at least one opening of the at least one driven endless belt to hold the sheets on the at least one driven endless belt;

the suction box comprising at least one opening, the at least one opening of the suction box being configured for being aligned with the at least one opening of the at least one driven endless belt to provide the suction force through the at least one opening of the at least one driven endless belt;

the at least one opening of the at least one driven endless belt comprising a plurality of openings;

the at least one opening of the suction box comprising a plurality of openings;

the plurality of openings of the suction box being configured for being aligned with the plurality of openings of the at least one driven endless belt;

a delivery station, the delivery station for being positioned adjacent the receiving means and being configured for receiving sheets from the receiving means;

the conveying means comprises and endless feed chain, the feed chain means comprising a plurality of grippers for successively gripping the sheets and releasing the sheets at the receiving means;

the feed chain having an upper run and a lower run, the lower run running in a direction parallel to the upper run of the at least one driven endless belt in the vicinity of the upper run of the at least one driven endless belt;

the means for driving the conveying means comprising first drive wheel means and a drive motor for driving the first drive wheel means;

the first drive wheel means being configured for transferring a driving force from the drive motor to the feed chain;

the means for driving the receiving means comprising:

second drive wheel means;

drive belt means extending form the first drive wheel means to the second drive wheel means, the drive belt means being configured for transferring a driving force from the first drive wheel means to the second drive wheel means;

the second drive wheel means being configured for transferring the driving force from the drive belt means to the at least one driven endless belt;

the synchronizing means comprising the drive belt means, the drive belt means being configured for decreasing the speed of the receiving means by a small amount with respect to that of the conveying means;

the first drive wheel means comprising a first drive wheel;

the second drive wheel means comprising a second drive wheel;

each of the first drive wheel and the second drive wheel being toothed;

the drive belt means comprising a toothed belt for being engaged with the teeth of the first drive wheel and the teeth of the second drive wheel;

the at least one driven endless belt having a total length define along the travel of the at least one driven endless belt;

the plurality of openings of the at lest one driven endless belt being disposed over a minor portion of the total length of the at least one driven endless belt;

the plurality of openings of the suction box for being aligned with the plurality of openings of the at least one driven endless belt such that a suction force is provided on each sheet only during a deceleration phase;

the second drive wheel being a drive pinion;

the second drive wheel means further comprising a pinion gear;

the drive pinion being engaged with the pinion gear to drive the pinion gear;

the at least one driven endless belt being at least one toothed belt;

the pinion gear being engaged with the teeth of the at least one driven endless belt to drive the at least one driven endless belt;

the at least one driven endless belt comprising at least two driven endless belts;

the at least two driven endless belts being disposed parallel to one another;

each of the at least two driven endless belts being configure to pass over a corresponding zone of the suction box;

the plurality of openings of the suction box being disposed solely in the zones over which the at least two driven endless belts pass;

each of the at least two driven endless belts being mounted on a generally triangular loop;

the second drive wheel constituting an apex of the generally triangular loop;

a pair of guide rollers, each of the pair of guide rollers being disposed in the vicinity of the feed chain;

the pair of guide rollers being disposed to carry the upper strand of the at least one driven endless belt therebetween; and each of the pair of guide rollers constituting another corresponding apex of the generally triangular loop.

6. Method of holding down sheets in a sheet punching apparatus, the sheet punching apparatus being for punching a series of sheets and subsequently delivering the punched sheets;

said method comprising the steps of:

providing means for punching the sheets;

providing means for stacking the punched sheets;

providing means for conveying the punched sheets from the punching mans to the stacking means;

providing means for holding the sheets down prior to the sheets being stacked;

providing, for the holding means:

means for receiving the sheets, the receiving means separate from the conveying means, for supporting the sheets prior to being stacked; and suction means for holding the sheets on the receiving means;

providing means for driving the receiving means;

providing means for driving the conveying means;

providing means for coordinating the movement of the receiving means and the conveying means;

disposing the holding means between the punching means and the stacking means;

punching the sheets by means of the punching means;

stacking the punched sheets by means of the stacking means;

conveying the punched sheets, by means of the conveying means, from the punching means to the stacking means;

prior to the step of stacking the punched sheets, holding the sheets down by means of the holding means;

said step of holding the sheets down comprising the steps of:

receiving the sheets on the receiving means;

supporting the sheets by means of the receiving means;

holding the sheets on the receiving mans by means of the suction means;

driving the receiving means;

driving the conveying means; and coordinating the driven movement of the receiving means and the conveying means;

said step of providing the coordinating means comprising the step of providing means for synchronizing the driven movement of the receiving means and the conveying means;

said coordinating step comprising the step of synchronizing the driven movement of the receiving means and the conveying means;

said step of driving the conveying means comprising at least the steps of:

driving the conveying means to convey the sheets through an acceleration phase; and driving the conveying means to convey the sheets through a deceleration phase;

said step of providing the synchronizing means comprises the step of providing mans for synchronizing the driven movement of the receiving means with the acceleration and deceleration phases of the conveying means and decreasing the speed of the receiving means by a small amount with respect to that of the conveying means;

said synchronizing step comprises the steps of synchronizing the driven movement of the receiving means with the acceleration and deceleration phases of the conveying means and delaying the driven movement of the receiving means by a small amount with respect to the acceleration and deceleration phases of the conveying means;

configuring the synchronizing means for providing a tension on each of the sheets as a result of the delay of the driven movement of the receiving means with respect to the acceleration and deceleration phases of the conveying means, the provided tension for being significantly less than a tear strength of each of the sheets;

said synchronizing step comprising the step of providing a tension on each of the sheets as a result of the delay of the driven movement of the receiving means with respect to the acceleration and deceleration phases of the conveying means, the provided tension for being significantly less than the tear strength of each of the sheets;

said step of providing the receiving mans comprising the step of providing at least one driven endless belt, the at least one driven endless belt has an upper run, the upper run of the at least one driven endless belt for receiving the sheets thereupon and supporting the sheets;

disposing the suction means below the upper run of the at least one driven endless belt;

configuring the at least one driven endless belt to comprise at least one opening for permitting the application of a suction force from the suction means onto an underside of the sheets to hold the sheets on the at least one driven endless belt;

said receiving step comprising the step of receiving the sheets upon the upper run of the at least one driven endless belt and supporting the sheets thereupon;

said holding step comprising the step of applying, via the at least one opening of the at least one driven endless belt, a suction force from the suction means onto an underside of the sheets;

configuring the apparatus such that the apparatus comprises:

the suction means comprising a suction box, the suction box being disposed below the upper run of the at least one driven endless belt; p2 the suction box comprising an upper portion disposed parallel to the upper run of the at least one driven endless belt;

the suction box being configured to provide the suction force through the at least one opening of the at least one driven endless belt to hold the sheets on the at least one driven endless belt;

the suction box comprising at least one opening, the at least one opening of the suction box being configured for being aligned with the at least one opening of the at least one driven endless belt to provide the suction force through the at least one opening of the at least one driven endless belt;

the at least one opening of the at least one driven endless belt comprising a plurality of openings;

the at least one opening of the suction box comprising a plurality of openings;

the plurality of openings of the suction box being configured for being aligned with the plurality of openings of the at least one driven endless belt;

a delivery station, the delivery station for being positioned adjacent the receiving means and being configured for receiving sheets from the receiving means;

the conveying means comprises an endless feed chain, the feed chain comprising a plurality of grippers for successively gripping the sheets and releasing the sheets at the receiving means;

the feed chain having an upper run and a lower run, the lower run running in a direction parallel to the upper run of the at least one driven endless belt in the vicinity of the upper run of the at least one driven endless belt;

the means for driving the conveying means comprising first drive wheel means and a first drive motor for driving the first drive wheel means;

the first drive wheel means being configured for transferring a driving force from the first drive motor to the feed chain;

the means for driving the receiving means comprising second drive wheel means and a second drive motor for driving the second drive wheel means;

the second drive wheel means being configured for transferring a driving force from the second drive motor to the at least one driven endless belt;

the synchronizing means comprising:

speed sensor means for sensing a speed of the feed chain;

the speed sensor being connected with the first drive wheel means;

control means associated with the speed sensor means for controlling the second drive motor;

the control means being configured for controlling a speed of the second drive motor in relation to the sensed speed of the feed chain in order to synchronize the driven movement of the at least one driven endless belt with the acceleration and deceleration phases of the conveying means and decrease the speed of the at least one driven endless belt by a small amount with respect to that of the conveying means;

each of the first and second drive motors comprising a servomotor;

at least the second drive motor being an electric motor;

the at least one driven endless belt having a total length defined along the travel of the at lest one driven endless belt;

the plurality of openings of the at least one driven endless belt being disposed over a minor portion of the total length of the at least one driven endless belt;

the plurality of openings of the suction box for being aligned with the plurality of openings of the at least one driven endless belt such that a suction force is provided on each sheet only during a deceleration phase;

the second drive wheel means comprising a drive pinion;

the second drive wheel means further comprising a pinion gear;

the drive pinion being engaged with the pinion gear to drive the pinion gear;

the at least one driven endless belt being at least one toothed belt;

the pinion gear being engaged with the teeth of the at least one driven endless belt to drive the at least one driven endless belt;

the at least one driven endless belt comprising at least two driven endless belts;

the at least two driven endless belts being disposed parallel to one another;

each of the at lest two driven endless belts being configured to pass over a corresponding zone of the suction box;

the plurality of openings of the suction box being disposed solely in the zones over which the at least two driven endless belts pass;

each of the at least two driven endless belts being mounted on a generally triangular loop;

the second drive wheel constituting an apex of the generally triangular loop;

a pair of guide rollers, each of the pair of guide rollers being disposed in the vicinity of the feed chain;

the pair of guide rollers being disposed to carry the upper strand of the at least one driven endless belt therebetween; and each of the pair of guide rollers constituting another corresponding apex of the generally triangular loop.

* * * * *